US006197159B1

(12) United States Patent
Meinecke et al.

(10) Patent No.: US 6,197,159 B1
(45) Date of Patent: Mar. 6, 2001

(54) PAPER MAKING MACHINE AND METHOD FOR WEB TRANSFER

(75) Inventors: Albrecht Meinecke, Heidenheim; Helmut Heinzmann, Böhmenkirch, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/166,581

(22) Filed: Oct. 6, 1998

(30) Foreign Application Priority Data

Oct. 7, 1997 (DE) ..... 197 44 341

(51) Int. Cl.[7] ..... D21F 2/00

(52) U.S. Cl. ..... 162/205; 162/306; 162/358.3; 162/359.1; 162/360.3

(58) Field of Search ..... 162/205, 306, 162/358.3, 359.1, 360.2, 360.3

(56) References Cited

U.S. PATENT DOCUMENTS

| | | | | |
|---|---|---|---|---|
| 3,595,745 | * | 7/1971 | Cronin | 162/306 |
| 4,359,828 | | 11/1982 | Thomas . | |
| 4,483,745 | | 11/1984 | Wicks et al. . | |
| 4,943,351 | * | 7/1990 | Wedel | 162/205 |
| 5,178,732 | | 1/1993 | Steiner et al. | 162/360.2 |
| 5,240,563 | * | 8/1993 | Karvinen et al. | 162/360.3 |
| 5,368,697 | | 11/1994 | Steiner et al. | 162/360.2 |
| 5,534,116 | | 7/1996 | Karvinen et al. . | |
| 5,545,292 | | 8/1996 | Fujita et al. | 162/358.1 |
| 5,876,565 | * | 3/1999 | Laapotti | 162/360.2 |

FOREIGN PATENT DOCUMENTS

| | | |
|---|---|---|
| 3808293 | 9/1989 | (DE) . |
| 4026021 | 2/1992 | (DE) . |
| 4116221 | 11/1992 | (DE) . |
| 4229683 | 4/1993 | (DE) . |
| 4321399 | 11/1993 | (DE) . |
| 4301750 | 7/1994 | (DE) . |
| 19633958 | 10/1997 | (DE) . |
| 29723115 | 5/1998 | (DE) . |
| 0576115 | 12/1993 | (EP) . |
| 91/12370 | 8/1991 | (WO) . |

* cited by examiner

*Primary Examiner*—Karen M. Hastings
(74) *Attorney, Agent, or Firm*—Greenblum & Bernstein, P.L.C.

(57) ABSTRACT

In a paper making machine for manufacturing a material web (10), such as in particular a paper or cardboard web, the material web (10) to be manufactured is transferred on the surface of a transfer means (24) to a take-off position (30) in the region of which a preferably air-permeable belt (32) having an at least substantially open surface is guided over a take-off roll (34) or the like and takes off the material web (10) from the surface of the transfer means (24). A pressing gap (36) extended in the web running direction (L) is formed at the take-off position (30) with the surface of the transfer means (24, 60) facing the material web (10) being deflected in the region of the extended pressing gap, while forming an at least substantially concave depression (38), and also being pressed by a pressing force intentionally generated in the region of this deflection against the take-off roll (34) in order to thereby assist the take-off of the material web (10) from the surface of the transfer means.

61 Claims, 4 Drawing Sheets

PAPER MAKING MACHINE AND METHOD FOR WEB TRANSFER

CROSS-REFERENCE TO RELATED APPLICATIONS

The present application claims priority under 35 U.S.C. § 119 of German Patent Application No. 197 44 341.9, filed on Oct. 7, 1997, the disclosure of which is expressly incorporated by reference herein in its entirety

BACKGROUND OF THE INVENTION

1. Field of the Invention

The invention relates to a paper making machine, and to a method for the manufacture of a material web such as in particular a paper or cardboard web, in which the material web to be manufactured is transferred on the surface of a transfer means to a take-off position, where a preferably air-permeable belt having an at least substantially open surface is guided over a take-off roll or the like and takes off the material web from the surface of the transfer means.

2. Discussion of the Background Information

The disturbing influences of the air movements on the running of the paper web increase with increasing speeds of the paper making machines. In this respect the edges of the web are in particular increasingly loaded, which leads to web edge fluttering which can lead to faults in the paper and indeed to tears. The runability and the efficiency of the paper making machine are thus greatly impaired. As a consequence it is necessary for the paper web to be fully supported during its run through the respective paper making machine, in particular on passing through the wet section, and free drafts should be avoided.

Various measures are already known for this purpose. Thus, in a paper making machine known from U.S. Pat. No. 4,359,828 an endless transfer belt is provided which runs through pressing gaps provided at a central roll of a compact pressing section. The paper web is located here at the outer side of the transfer belt. It is fully supported up to a transfer point and transferred without a free draft to a drying screen. The transfer belt in this arrangement has a substantially lower porosity than, for example, a pressing felt that is provided, or the dryer screen.

A transfer belt of this kind having a lower porosity in comparison with the porosity of the felts and screens is also used in a paper making machine known from U.S. Pat. No. 4,483,745. The porosity of this transfer belt is intended to be so low that it is practically water-impermeable. Belts of this kind have the advantage that with them, in comparison to press felts, the return wetting of the web is reduced or indeed avoided.

Such water-impermeable or substantially water-impermeable belts however give rise to further problems. Thus, on the one hand, the take-off of the paper web from a belt having a relatively closed surface and the transfer to the open dryer screen is problematic, and it is also difficult to keep the belt clean.

In a paper making machine which is known from example from U.S. Pat. No. 5,240,563, or from U.S. Pat. No. 5,534,116, the web transfer is to be assisted in that the transfer belt is deflected with the web, for example by deflection means, ahead of a suction roll around which the drying screen is guided. Alternatively a cylinder can be provided in the transfer belt loop with a suction device being provided in the region of the cylinder and downstream thereof which leads the web away from the transfer belt to the drying screen.

These known proposals bring, amongst other things, the disadvantage that the contact between the web and the drying screen is produced solely by the dipping of the cylinder into the transfer belt, or by the dipping of the suction roll into the paper carrying transfer belt. As a consequence an enhancement of the contact can only be achieved by a further dipping in of the relevant elements.

This in turn brings the disadvantage with it that the tension of the transfer belt is impaired. Moreover, the relevant element undergoes non-uniform bending deflection over the width of the machine, which leads to different pressures between the web and the dying screen. Thus a non-uniform transfer takes place when considered over the machine width or the pressure cannot be increased to the degree required for reliable transfer.

Moreover, the means used in the previously known paper making machines for the cleaning of the transfer belt are inadequate. These also bring about a relatively pronounced mechanical loading of the belt, which is in particular to be attributed to the bending change which takes place in the so-called conditioning nip. Finally, the use of contacting cleaning elements such as scrapers and brushes leads to a wearing of the surface of the belt. This is in particular disadvantageous when the surface has a functional roughness, such as is for example the case with a paper making machine known from EP-B1-0 576 115.

SUMMARY OF THE INVENTION

The invention is based on the object of so further developing a paper making machine, and also a method, of the initially named kind that ideal conditions are always ensured, even with higher running speeds and such that a reliable operation of the paper making machine is ensured.

With respect to the paper making machine this object is satisfied, in accordance with the invention, in that a pressing gap extended in the web running direction is formed at the take-off position with the surface of the transfer device facing the material web being deflected in the region of the extended pressing gap while forming an at least substantially concave depression and also being pressed by a pressing force intentionally generated in the region of this deflection against the take-off roll, in order to thereby assist the take-off of the material web from the surface of the transfer device.

In this design the transfer device can for example be formed by a substantially water-impermeable transfer belt.

In certain cases it is of advantage when the transfer device has an at least substantially smooth surface.

In an expedient practical embodiment the surface of the transfer device has a functional roughness.

Frequently it is also of advantage when the surface of the transfer device is at least substantially closed.

The invention can thus be generally used for the web take-off by an air-permeable fabric from a transfer device, with this transfer device for example being formed by an at least substantially water-impermeable belt. The surface of the transfer device can for example be at least substantially smooth, provided with a functional roughness and/or at least substantially closed.

The transfer device can in particular be formed by an endless transfer belt which is deflected in the region of the pressing gap provided at the take-off position into the interior of the belt loop while forming the concave depression and by being pressed against the take-off roll by pressing device provided in the region of the pressing gap and arranged within the belt loop.

Accordingly, a compression of the transfer belt takes place in the region of the take-off position at the side of the transfer belt facing the material web, while this transfer belt experiences an extension at the opposite side remote from the material web. Through the combination of such a deflection of the transfer belt in the region of the take-off position with the simultaneous pressing of the web onto the take-off roll with an adequate minimum pressing force a transfer of the web from the transfer belt to the preferably air-permeable belt having an at least substantially open surface is ensured, which is reliable to a high degree. It is in particular important that the transfer belt is deflected into the interior of the belt loop so that, as a result of the resulting concave deformation of the belt, the surface of the belt facing the material web is compressed, whereby the web can be loosened and the web can be more easily separated and transferred without problem in conjunction with the pressing with the required minimum pressing force. Thus, an extremely reliable transfer of the web can basically be achieved already through the relaxation which takes place on the one side and the stressing which takes place on the other side, in conjunction with the pressing of the inwardly deflected transfer belt against the take-off roll, which takes place in accordance with a minimum pressing force. In contrast, with a convex deformation or arching of the belt, such as for example occurs, when using an inwardly disposed cylinder (see for example U.S. Pat. No. 5,534,116) the web is tensioned and clamped even more onto the transfer belt.

In an embodiment of the paper making machine of the invention which preferred in practice the pressing device has pressing surface facing the material web which is concavely curved, at least after achieving a specific pressing pressure. In this respect the concave curvature of the pressing surface can be at least substantially complementary to the cylindrical surface of the take-off roll.

In an expedient embodiment of the paper making machine of the invention the pressing device include a pressing roll consisting of an elastic material, the surface of which can be concavely deformed by the pressing against the take-off roll. In this respect the pressing roll can for example be a full roll consisting of elastic material.

In an advantageous alternative embodiment the pressing device include at least one pressing shoe with a concave pressing surface confronting the material web.

This pressing shoe is expediently pressed against the take-off roll by a plurality of pressing elements distributed over the machine width. In this arrangement the pressing elements can be energized at least partly independently of one another.

The lubrication of the pressing surface of the pressing shoe expediently takes place hydrodynamically and/or hydrostatically. In this arrangement a water spray pipe extending at least substantially over the machine width can for example be provided within the loop of the transfer belt. Alternatively, or additionally, the transfer belt can be provided at its inner side with a wear resistant and/or friction reducing layer.

In an embodiment of the paper making machine of the invention preferred in practice the transfer belt is formed by a pressing belt. This pressing belt can be led together with the material web, in the web running direction before the pressing gap provided at the take-off position, through at least one further pressing gap of a press section serving for the treatment of the material web.

In an expedient practical embodiment the pressing belt is formed by the pressing jacket of a shoe press, with the pressing device provided in the region of the take-off position within the pressing jacket in this case including at least one pressing shoe with a concave pressing surface confronting the material web.

The pressing shoe can be pressed against the take-off roll by a plurality of pressing elements distributed over the machine width and these pressing elements can preferably be energized at least partly independently of one another.

In this case the pressing surface of the pressing shoe can also be either hydrodynamically and/or hydrostatically lubricated.

In a practical embodiment of the paper making machine of the invention the shoe pressing roll associated with a pressing section forms, together with a respective counter-surface, in the web running direction before the pressing gap provided at the take-off position, at least one further pressing gap serving for the treatment of the material web. In this case at least one such further pressing gap associated with the pressing section is expediently felted and the relevant counter-surface is formed by a counter roll against which the pressing jacket of the shoe pressing roll can be pressed by at least one pressing shoe.

The counter roll can for example be formed by a roll with a relatively rigid roll jacket, or alternatively by a shoe pressing roll with at least one pressing shoe provided in the region of the relevant pressing gap and arranged within the flexible pressing jacket.

In an embodiment of the paper making machine which is preferred in practice the take-off roll is formed by a suction roll. As already mentioned the suction arrangement at the take-off position is however not absolutely essential, because the relaxation at the one side and the stressing at the other side in conjunction with the pressing towards the take-off roll, which takes place in accordance with a minimum pressing force, already ensures a reliable web take-over. This take-over can however be further optimized by an appropriate suction arrangement.

A particularly reliable web guidance is achieved when the suction zone of the suction roll extends in the running direction of the web beyond the pressing gap formed at the take-off position.

The belt guided over the take-off roll having an at least substantially open surface can for example be a dryer screen of a dryer section. The take-off position can thus for example be provided between a pressing section and a dryer section of the paper making machine.

The take-off roll can be shaped in order to ensure a uniform surface pressure even with bending deflection of the roll.

In order to achieve the most ideal and careful belt cleaning possible device are provided, in an embodiment which is preferred in practice, for a contact-free and/or non-scraping cleaning of the outside of the transfer belt in the web running direction after the take-off position These cleaning device can include at least one jet cleaning device. In this arrangement at least one jet cleaning device is expediently be provided in which the cleaning takes place through a rotating water jet, which is for example produced by a rotating water nozzle, such as is used for the cleaning of dryer screens. At least one such jet cleaning device can be formed as a traversing cleaning device.

In a device of this kind the build-up of layers of, for example, fine materials or chemicals used during paper manufacturing, can, for example, be prevented, i.e. coatings of this kind can be removed.

A spray tube extending substantially over the machine width, preferably a spray tube delivering a lower jet pressure, can additionally be provided in the web running direction after the jet cleaning device. In this arrangement at least one cleaning roll with an associated scraper and/or at least one foil bringing about contact-less cleaning is preferably provided in the web running direction after the additional spray tube. Using the later arranged second spray tube of smaller jet pressure the belt can in particular be sprayed over the entire machine width whereby, in conjunction with a foil which brings about contact-free cleaning, or in conjunction with the cleaning roll with a scraper, slightly adherent contamination can in particular be removed.

The use of a combination of these devices is in particular of special advantage, whereby a careful and uniform cleaning of the belt is ensured and the belt is always kept uniformly clean. Wear of the belt is prevented. Through the use of only a few, or even of only one traversing nozzle with a high energy water jet. the energy consumption is reduced in comparison to a plurality of stationary high pressure nozzles.

In an embodiment preferred in practice of the paper making machine of the invention the transfer belt is guided in the web running direction after the take-off position over a deflection roll, with the jet cleaning device being arranged before the deflection roll and the additional spray tube with the subsequent cleaning roll and scraper and/or subsequent foil being arranged after the deflection roll.

A scraper can also be associated with the deflection roll in order to scrape off the material web from the belt with an open gap. During normal operation of the paper making machine this scraper is in contrast not in engagement with the deflection roll.

A heating device can be associated at least with the jet cleaning device and/or with the additional spray tube.

A further advantageous variant of the paper making machine of the invention is characterized in that an endless transfer belt is provided as the transfer device; in that the pressing gap provided at the take-off position is formed between the take-off roll and at least one counter-element; and in that the at least substantially concave depression in the surface of the transfer belt confronting the material web is produced by a deformation of the transfer belt having a corresponding thickness and flexibility resulting from the pressing of the take-off roll into the transfer belt material.

In this case the take-off pressure is also produced by a corresponding pressing of the take-off roll and/or the corresponding pressing of the pressing device, i.e. of the counter-element. The concave depression is however no longer preset by this counter-element but rather by a one sided deformation of the transfer belt resulting from the pressing of the take-off roll into the transfer belt material which has a corresponding thickness and flexibility for this purpose.

The transfer belt can for example be formed again by a pressing belt and in particular by a pressing jacket.

In the case of using a pressing jacket the counter-element preferably has a support surface facing the pressing jacket with the radius of curvature of the support surface being at least substantially the same as the inner radius of the pressing jacket. The radius of curvature of the support surface can thus in particular also be larger than the radius of curvature of the concave depression which is determined by the outer diameter of the take-off roll.

The transfer belt can, for example, consists of a material with a hardness in the range of approximately 90 Shore A.

In an expedient practical embodiment the transfer belt has a thickness which is larger than or the same as approximately 3 mm and preferably lies in a range from about 4 mm to about 5 mm.

The method of the invention is characterized in that the surface of the transfer device facing the material web in the region of the take-off position is deflected while forming an at least substantially concave depression; and in that the material web and the take-off belt are pressed against one another in the region of this deflection in order to thereby assist the take-off of the material web from the surface of transfer device.

As transfer device an at least substantially water-impermeable transfer belt can for example be used again. The surface of the transfer device can, for example, be at least substantially smooth, be provided with a functional roughness and/or at least be substantially closed.

Further advantageous embodiments of the method of the invention are set forth in the subordinate claims.

The web take-off in accordance with the invention is, for example, conceivable in the region of or following the last pressing gap of a press section of a relevant paper making machine. It can in particular take place through a dryer screen of a drying section.

BRIEF DESCRIPTION OF THE DRAWINGS

The invention will be explained in more detail in the following with reference to embodiments and the drawing in which are shown.

DETAILED DESCRIPTION OF THE INVENTION

Figure 1:
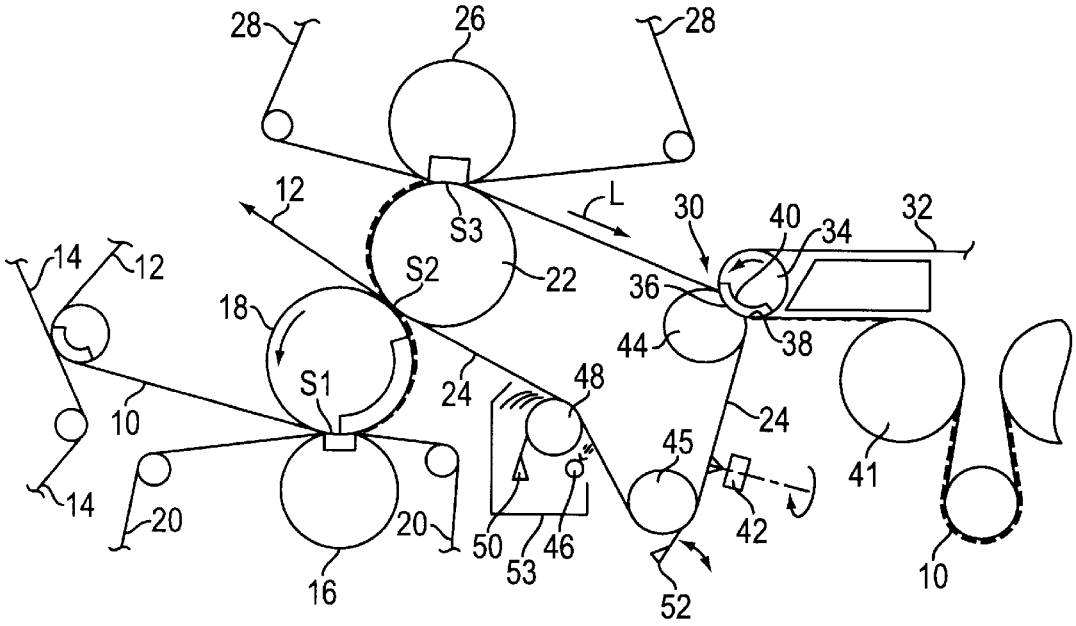
FIG. 1 a simplified schematic partial illustration of an embodiment of a paper making machine, in which an endless transfer belt guiding the material web is pressed by a pressing roll consisting of an elastic material against a take-off roll, FIG. 2 a simplified schematic partial illustration of the transfer belt deflected in the region of the take-off position, FIG. 3 a simplified schematic partial illustration of a further embodiment of the paper making machine, in which the transfer belt is pressed by a pressing shoe against the take-off roll, FIG. 4 a simplified schematic partial illustration of a further embodiment of the paper making machine in which the transfer belt is formed by the pressing jacket of a shoe pressing roll which is pressed by a pressing shoe against the take-off roll and in which the material web on the surface of the shoe pressing roll is guided, starting from a pressing gap, to the take-off position which is formed between the shoe pressing roll and a counter-roll with a rigid roll jacket, FIG. 5 a simplified schematic partial illustration of a further embodiment of the paper making machine comparable with that of FIG. 3 in which the counter-roll is also formed by a shoe pressing unit, and FIG. 6 a simplified schematic partial illustration of a further embodiment of a paper making machine in which the transfer belt is again formed by a pressing jacket and the pressing gap provided at the take-off position is again formed between a take-off roll and a counter-element, but in which the concave depression is however no longer predetermined by the counter-element, but is rather produced by a one sided deformation of the transfer belt resulting from the pressing of the take-off roll into the transfer belt material.

FIG. 1 shows a simplified schematic illustration of the pressing section and also a part of the drying section of a paper making machine for the manufacture of a material web 10, which can be a paper or card web.

The material web 10 is taken off from a screen belt 14 by a felt 12 and is supplied by the felt 12 to a first pressing gap S1 of the pressing section which is formed between a downwardly disposed shoe pressing roll 16 and a suction roll 18 arranged above it. As can be recognized with respect to FIG. 1 a further felt 20 is guided around the shoe pressing roll 16 so that a doubly felted or twin felt pressing gap S1 results. Thereafter the material web 10 is guided through a second pressing gap S2 which is formed between the suction roll 18 and a further pressure roll 22 about which an endless pressing belt 24 is guided. The material web passes via the pressing belt 24 guided around the pressing roll 22 to a third pressing gap S3 which is formed between the pressing roll 22 and a further shoe pressing roll 26 arranged above it. A felt 28 is again guided around this shoe pressing roll 26.

The endless pressing belt 24 guided around the pressing roll 22 simultaneously serves as a transfer device by which the material web 10 to be manufactured is transferred following the last pressing gap S3 of the press section to a take-off position 30 in the vicinity of which an air-permeable belt having an at least substantially open surface, in the present case a drying screen 32 of the dryer section, is guided via a take-off roll 34 and takes off the material web 10 from the surface of the pressing belt 24. In the present embodiment the take-off roll 34 is formed by a suction roll.

Transfer device of the most diverse kind are fundamentally conceivable in conjunction with a web take-off in accordance with the invention. A transfer belt of this kind can in particular be formed by a substantially water-impermeable transfer belt. The surface of the transfer device can for example be at least substantially smooth, or provided with a functional roughness and/or at least substantially closed.

In the present embodiment the pressing belt 24 can in particular be at least substantially water-impermeable. The surface of this pressing belt 24 can in particular be smooth and/or closed.

A pressing gap 36 extended in the web running direction L is formed at the take-off position 30. In the region of this pressing gap 36 the surface of the pressing belt 24 facing the material web 24 is both deflected inwardly while forming an at least substantially concave depression 38, and is also pressed by a pressing force intentionally produced in the region of this deflection against the take-off roll 34 in order to thereby assist the take-off of the material web 10 from the surface of the pressing belt 24.

As can be recognized with respect to FIG. 1 the material web 10 is fed, following the take-off position 30, by the dryer screen 32 to the first dryer cylinder 41 of the dryer section.

The pressing belt 24 which serves as a transfer belt is thus deflected in the region of the pressing gap 36 provided at the take-off position 30 into the interior of the belt loop while forming the concave depression 38, with the transfer belt additionally being pressed against the take-off roll 34 by special pressing device provided in the region of the pressing gap 36 and arranged within the belt loop. In the present case the pressing device are formed by a soft pressure roll 44 consisting of an elastic material the surface of which is concavely deformed by the pressing against the take-off roll 34. Thus a concavely curved pressing surface facing the material web 10 results which is complementary to the cylindrical surface of the take-off roll 34.

The pressing roll 44 can be a full roll consisting for example of an elastic material.

Figure 2:
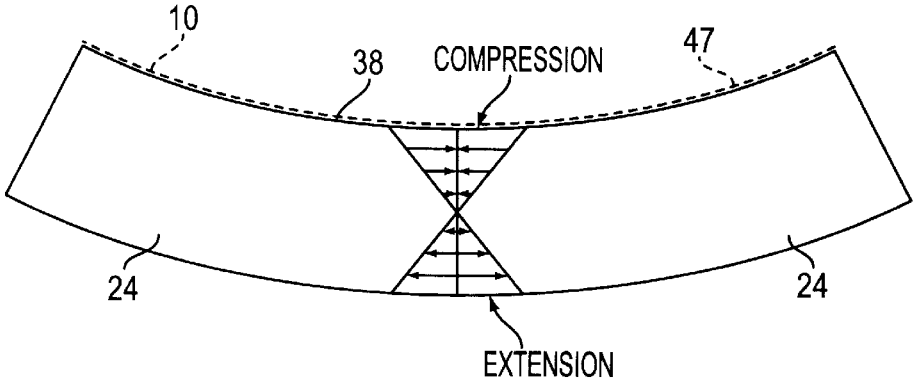

Thus, in the region of the pressing gap 36 which assists the web take-off the surface of the pressing belt 24 confronting the material web 10 is compressed, whereas this pressing belt 24 undergoes an extension at the opposite side (see FIG. 2). As a result of this deflection, which takes place while forming the concave depression 38, in conjunction with the pressing against the take-off roll 34, which takes place in accordance with a minimum pressing force, the take-off of the material web 10 from the surface of the pressing belt 24 and also the take-over by the dryer screen 32 is assisted in an ideal manner.

The suction zone 40 of the take-off roll 34, which is formed as a suction roll, extends in the web running direction L beyond the pressing gap 36 formed at the take-off position 30.

Device for a contact-free and/or non-scraping cleaning of the outer side of the pressing belt 24 are provided in the web running direction L after the paper of take-off position 30.

These cleaning device comprise a jet cleaning device 42 which is arranged between the take-off position 30 and the deflection roll 45 outside of the loop of the pressing belt 24. In the following case the jet cleaning device 42 includes a rotating nozzle for the production of a rotating water jet which strikes the outer side of the endless pressing belt 24. This jet cleaning device 42 can moreover be formed as a traversing cleaning device.

A spray tube 46, which extends at least substantially over the machine width and which preferably delivers a smaller jet pressure than the device 42, is additionally provided in the web running direction L after the deflection roll 45 and is followed by a cleaning roll 48 with an associated scraper 50. A foil can also basically be arranged after the spray tube 46. As can be recognized with the respective FIG. 1, a scraper 52 is also associated with the deflection roll 45. Moreover, a heating device can be associated at least with the jet cleaning device 42 and/or with the additional spray tube 46. A collection container 53 is also provided in the region of the cleaning roll 48 and of the spray tube 46.

Figure 3:
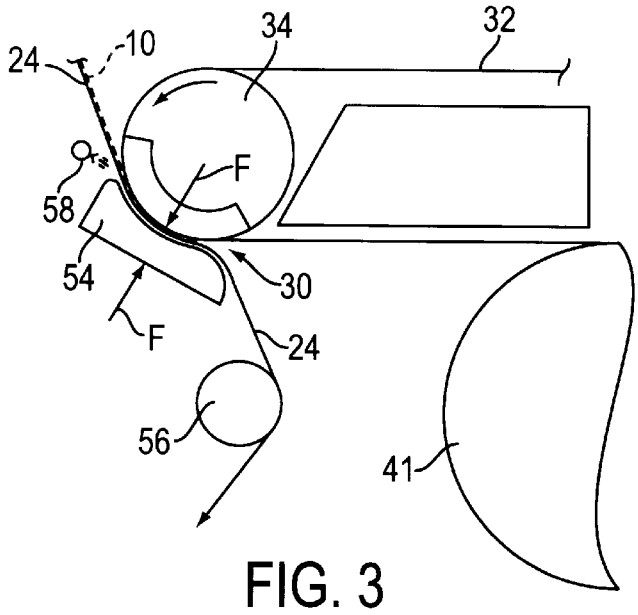

FIG. 3 shows a simplified schematic partial illustration of a further embodiment of a paper making machine in which the endless pressing belt 24 serving as the transfer device is pressed by a pressing shoe 54 against the take-off roll 34. As can be seen with respect to FIG. 3 this pressing shoe 54 has a concave pressing surface facing the material web 10 which is again at least substantially complementary to the cylindrical surface of the take-off roll 34. The pressing belt 24 is guided over a deflection roll 56 following the pressing shoe 54, i.e. the take-off position 30.

The pressing shoe 54 can be pressed against the take-off roll by a plurality of pressing elements distributed over the machine width, with these pressing elements being energizable at least partly independently of one another.

The pressing surface of the pressing shoe 54 can be hydrodynamically and/or hydrostatically lubricated. In accordance with FIG. 3 a spray tube 58 arranged within the belt loop is provided in the web running direction L in front of the pressing shoe 54 in order to act on the inner side of the pressing belt 24 with the corresponding liquid.

At its inner side the pressing belt 24 can be provided with a wear resistant and/or friction reducing layer.

In other respects this embodiment has the same layout as that of FIG. 1 Thus, in this case, the material web 10 is also led, following the take-off position 30, by the dryer screen 32 to the first dryer cylinder 41 of the dryer section.

Figure 4:
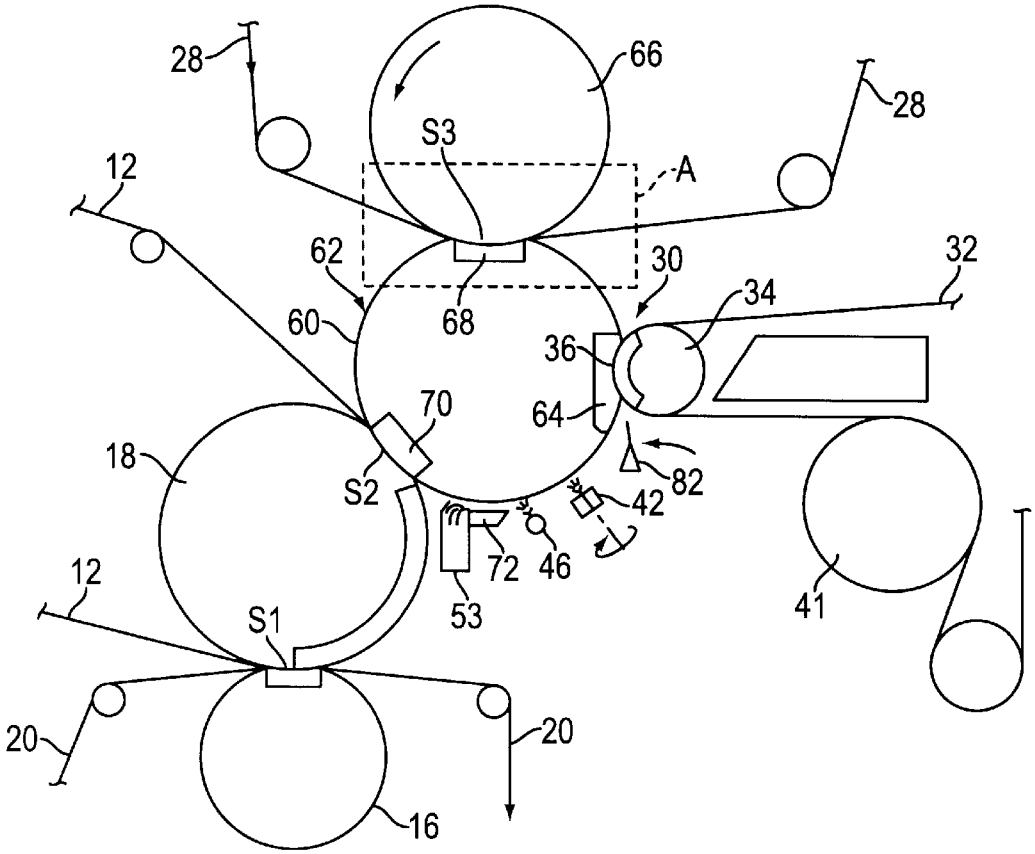

FIG. 4 shows a further embodiment of the paper making machine. In this case the transfer device is formed by the pressing jacket 60 of a shoe pressing roll 62. The pressing device provided in the region of the take-off position 30 and arranged within the pressing jacket 60 again include a pressing shoe 64. This pressing shoe also has a concave pressing surface confronting the material web 10 which is at least substantially complementary to the cylindrical surface of the take-off roll 34.

The pressing shoe 64 can also be pressed against the take-off roll 34, again by a plurality of pressing elements distributed over the machine width, with these pressing elements again being energizable at least partly independently from one another. The pressing surface of the pressing shoe 64 is again hydrodynamically and/or hydrostatically lubricated.

In the present case the last pressing gap S3 of the press section is formed by the shoe pressing roll 62 and an upwardly disposed pressing roll 66 with a rigid roll jacket around which the felt 28 extends. The pressing jacket 60 of the shoe pressing roll 62 is pressed by a pressing shoe 68 against the upwardly disposed pressing roll 66.

Moreover, the shoe pressing roll 62 together with the suction roll 18 forms the second pressing gap S2 of the press section. In the region of the second pressing gap S2 the pressing jacket 60 of the shoe pressing roll 62 is pressed by a pressing shoe 70 with a convex pressing surface against the suction roll 18, i.e. is supported opposite to the latter.

As can be recognized with respect to FIG. 4 a jet cleaning device 42 and a spray tube 46 are again provided in the web running direction after the take-off position 30, i.e. after the pressing gap 36 which assists the take-off. In this case a foil 72 is arranged after the spray tube 46. Moreover, a collection container 53 is again provided in the region of the foil 72.

In other respects is embodiment has the same layout as that of FIG. 1 with parts which correspond to one another being provided with the same reference numerals.

Figure 5:
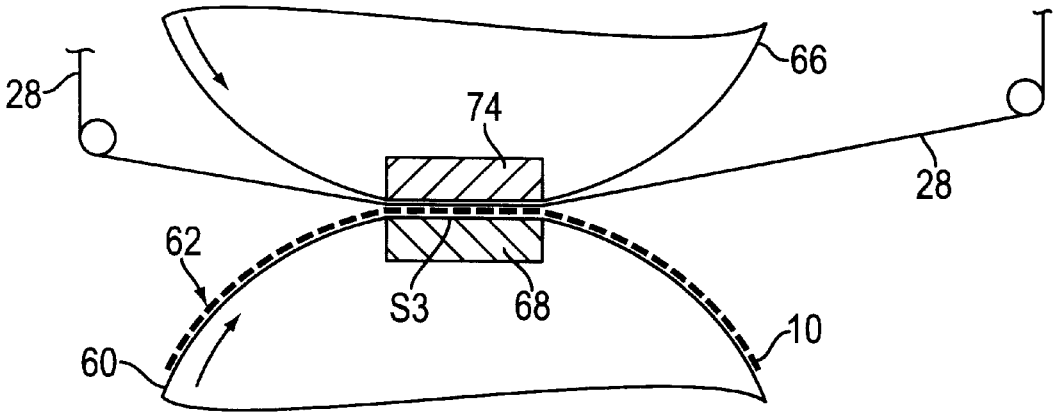

FIG. 5 shows the section "A" in FIG. 4 of a further embodiment of the paper making machine. In this embodiment the upwardly disposed pressing roll 66 is formed in just the same way as the pressing roll 62 as a shoe pressing roll with a flexible, water-impermeable pressing jacket. The pressing jacket of these shoe pressing rolls 62, 66 are pressed against one another by oppositely disposed pressing shoes 68, 74 in the region of the pressing gap S3. In this FIG. 5 the felt 28 which extends around the upper pressing roll 62 can also be recognized. In other respects this embodiment has the same layout as that of FIG. 4, with parts which corresponds to one another again being provided with the same reference numerals. The material web 10 is thus also transferred in the present case from the last pressing gap S3 of the press section by the pressing jacket 60 of the shoe pressing roll 62 to the take-off position at which the take-over by a drying screen of the dryer section takes place assisted by the pressing gap 36 (compare FIGS. 1 and 4 ).

Figure 6:
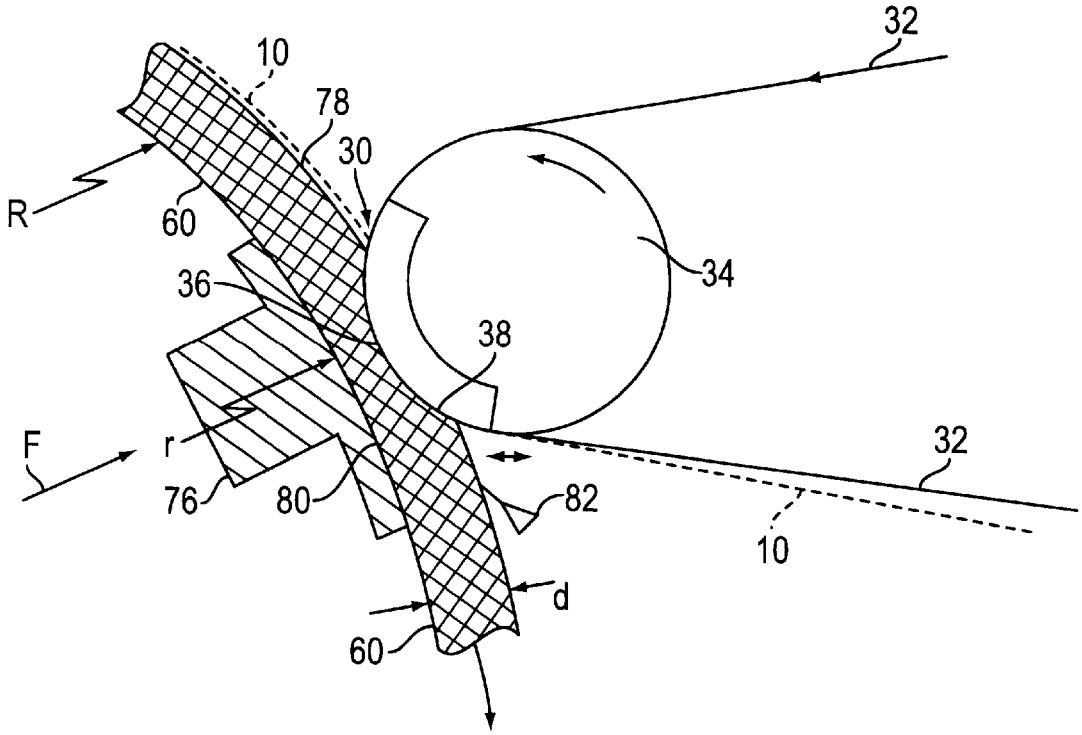

FIG. 6 shows in a simplified schematic partial illustration a further embodiment of a paper making machine. In this case the transfer device is indeed again formed by a pressing jacket 60 and the pressing gap 36 provided at the take-off position 30 is again formed between a take-off roll 34, and indeed a suction roll, and a counter-element 76. The concave depression 38 is however no longer formed by the counter-element 64 or 76, as for example in the embodiment of FIG. 4, but rather by a one sided deformation of the pressing jacket 60 which results by pressing of the take-off roll 34 into the transfer belt material, which has for this purpose a corresponding thickness d and flexibility.

In the present case the support surface 80 of the counter-element 76 facing the pressing jacket 60 has a radius of curvature r which is at least substantially the same as the inner radius R of the pressing jacket 60. The radius of curvature r of the support surface 80 is thus larger than the radius of curvature of the concave depression 38, which is solely determined by the outer diameter of the take-off roll 34.

The pressing jacket 60 can for example consist of a material with a hardness in the range of about 90 Shore A.

In the present embodiment the pressing jacket 60 has a thickness d which is larger than or the same as 3 mm and preferably lies in a range of about 4 mm to about 5 mm.

The take-off pressure can be produced by a corresponding pressing of the take-off roll 34 and/or by the corresponding pressing of the counter-element 76.

As is also the case in the embodiment of FIG. 4 a scraper 82 is associated with the pressing jacket 60 in the region of the pressing gap 36 in order to scrape off the material web 10 from the pressing jacket 60 with an open gap. This scraper 82 is however not in engagement with the pressing jacket 60 during the normal operation of the paper making machine.

In other respects this embodiment can for example have the same layout as the previously described embodiments, with parts which correspond to one another being provided with the same reference numerals. Thus, for example, in the present case a dryer screen 32 of the dryer section is again guided over the take-off roll 34 so that the material web 10 is taken off by this dryer screen 32 from the surface 78 of the pressing jacket 60.

Reference Numeral list

| | |
|---|---|
| 10 | material web |
| 12 | felt |
| 14 | screen belt |
| 16 | shoe pressing roll |
| 18 | suction roll |
| 20 | felt |
| 22 | pressing roll |
| 24 | pressing belt |
| 26 | shoe pressing roll |
| 28 | felt |
| 30 | take-off position or point |
| 32 | dryer screen |
| 34 | take-off roll |
| 36 | pressing gap |
| 38 | concave depression |
| 40 | suction zone |
| 41 | dryer cylinder |
| 42 | jet cleaning device |
| 44 | elastic pressing roll |
| 45 | deflection roll |
| 46 | spray tube |
| 48 | cleaning roll |
| 50 | scraper |
| 52 | scraper |
| 53 | collection container |
| 54 | pressing shoe |
| 56 | deflection roll |
| 58 | spray tube |
| 60 | pressing jacket |
| 62 | shoe pressing roll |
| 64 | pressing shoe |
| 66 | pressing roll |
| 68 | pressing shoe |
| 70 | pressing shoe |
| 72 | foil |
| 74 | pressing shoe |
| 76 | counter-element |
| 78 | surface |
| 80 | support surface |

-continued

| Reference Numeral list | |
|---|---|
| 82 | scraper |
| d | thickness |
| r | radius of curvature |
| R | inner radius |
| L | web running direction |
| S1 | pressing gap |
| S2 | pressing gap |
| S3 | pressing gap |

What is claimed is:

1. A paper making machine for manufacturing a material web, comprising:

a suction take-off roll having a cylindrical surface;

a pressure element comprising one of a soft counter roll and a curved press shoe;

a transfer surface comprising one of a flexible press jacket and a transfer belt, the transfer surface having a pressure element engaging side and an opposite web carrying side, the transfer surface being adapted to carry said web, said transfer surface passing through an extended pressing gap, and being deflected from the web carrying side of the cylindrical surface of the take-off roll;

the pressure element applying pressure against the take-off roll to define said extended pressing gap between the take-off roll and the transfer surface, the extended pressing gap having a substantially concave shaped depression, wherein the depression is formed via the clyindrical surface of the take-off roll in one of the soft counter roll, the curved press shoe, a web carrying surface of the transfer belt, and a web carrying surface of the flexible press jacket;

an air-permeable belt having a substantially open surface, said belt being guided over said take-off roll to pass through said extended pressing gap;

wherein said web will transfer from said transfer surface to said air-permeable belt in the region of said extended pressing gap.

2. The paper making machine of claim 1, wherein said transfer surface is a substantially water-impermeable transfer belt.

3. The paper making machine of claim 1, wherein a surface of said transfer surface is substantially smooth.

4. The paper making machine of claim 1, wherein a surface of said transfer surface has a predetermined roughness.

5. The paper making machine of claim 1, wherein a surface of said transfer surface is substantially closed.

6. The paper making machine of claim 1, wherein said transfer surface is an endless transfer belt forming a loop, which is deflected inward in the region of said pressing gap to form said corresponding substantially concave depression, said pressing element is positioned within said loop, and presses said transfer belt towards said take-off roll.

7. The paper making machine of claim 6, wherein said pressing element has a pressing surface facing said material web at said pressing gap, said pressing surface having a concave curvature.

8. The paper making machine of claim 6, wherein said pressing element has a pressing surface facing said material web in the region of said pressing gap, said pressing surface having a concave curvature when deformed under a specific pressure.

9. The paper making machine of claim 7, wherein said concave curvature of said pressing surface substantially corresponds to the surface of said take-off roll.

10. The paper making machine of claim 6, wherein said pressing element is a pressing roll having an elastic material, said elastic material deforming to form said corresponding substantially concave depression through contact pressure with said take-off roll.

11. The paper making machine of claim 10, wherein said pressing roll has a solid core and an outer section of said elastic material.

12. The paper making machine of claim 6, wherein said pressing element is a pressing shoe having a concave shaped pressing surface facing said material web in a region of said pressing gap.

13. The paper making machine of claim 12, wherein a plurality of pressing members, disposed over a width of said paper making machine, press said pressing shoe towards said take-off roll.

14. The paper making machine of claim 13, wherein at least one of said plurality of pressing members can be activated independently of others of said plurality of pressing members.

15. The paper making machine of claim 12, wherein a pressing surface of said pressing shoe is at least one of hydrodynamically and hydrostatically lubricated.

16. The paper making machine of claim 15, further comprising a spray tube, positioned inside said loop of said transfer belt, extending substantially over the width of said paper making machine.

17. The paper making machine of claim 1, wherein an inner side of said transfer belt is provided with at least one of a wear resistance and friction reducing layer.

18. The paper making machine of claim 1, wherein said transfer surface is a pressing belt.

19. The paper making machine of claim 18, further comprising at least one additional pressing gap disposed upstream from said pressing gap in a direction of said travel path, said pressing belt passing through said at least one additional pressing gap for the treatment of said material web.

20. The paper making machine of claim 18, wherein said pressing belt comprises a pressing jacket of a shoe pressing roll provided in the region of said pressing gap, wherein said pressing jacket includes at least one pressing shoe with a concave pressing surface facing said material web.

21. The paper making machine of claim 20, further comprising a plurality of pressing members, distributed over a width of said paper making machine, which press said pressing shoe towards said take-off roll.

22. The paper making machine of claim 21, wherein at least one of said plurality of pressing members can be operated independently of others of said pressing members.

23. The paper making machine of claim 20, wherein said pressing surface is at least one of hydrodynamically and hydrostatically lubricated.

24. The paper making machine of claim 19, wherein said at least one additional pressing gap is defined between a shoe pressing roll and an opposing surface.

25. The paper making machine of claim 24, wherein said opposing surface is a counter roll, said at least one additional pressing gap has felt at least partially around a surface thereof, and at least one pressing shoe of said press jacket presses said shoe pressing roll against said counter roll.

26. The paper making machine of claim 25, wherein the counter roll is a shoe pressing roll having at least one pressing shoe provided in the region of the associated one of said at least one additional pressing gap.

27. The paper making machine of claim 1, wherein a suction zone of said take-off roll extends in a direction of travel of said material web beyond said pressing gap.

28. The paper making machine of claim 1, wherein said air permeable belt is a drying screen of a drying section of said paper making machine.

29. The paper making machine of claim 1, further comprising a device for clearing said transfer surface, disposed downstream of said pressing gap in said travel path.

30. The paper making machine of claim 29, wherein said device for cleaning includes at least one cleaning jet device.

31. The paper making machine of claim 30, wherein said at least one cleaning jet device comprises a rotating water jet.

32. The paper making machine of claim 30, wherein said at least one cleaning jet device is a traversing cleaning device.

33. The paper making machine of claim 29, further comprising a spray tube, extending substantially over a width of said paper making machine, for delivering jet pressure, said spray tube being provided downstream from said at least one cleaning jet device in said travel path.

34. The paper making machine of claim 33, further comprising at least one cleaning roll having at least one of an associated scraper and foil operatively associated therewith for cleaning said transport surface downstream from said spray tube.

35. The paper making machine of claim 29, wherein located downstream from said pressing gap said travel path is a deflection roll, a jet cleaning device, a spray tube, and a cleaning roll, and at least one of a first scraper and foil.

36. The paper making machine of claim 35, further comprising a second scraper associated with the deflection roll.

37. The paper making machine of claim 33, further comprising a heating device associated with at least one of said at least one jet cleaning device and said spray tube.

38. The paper making machine of claim 1, wherein said transfer surface is an endless transfer belt, said pressing gap is formed between said take-off roll and at least one counter element, and said substantially concave depression in said transfer belt is produced by deforming the transfer belt, said transfer belt having a corresponding thickness and flexibility from the take-off roll pressing into the transfer belt.

39. The paper making machine of claim 38, wherein the transfer belt is a pressing belt.

40. The paper making machine of claim 39, wherein the transfer belt is a pressing jacket.

41. The paper making machine of claim 40, wherein the counter element has a support surface facing the pressing jacket, the support surface having a radius of curvature substantially equal to the inner radius of said pressing jacket.

42. The paper making machine of claim 38, wherein said transfer belt is of a material with a hardness of approximately 90 Shore A.

43. The paper making machine of claim 38, wherein said transfer belt has a thickness which is at least approximately equal to 3 mm.

44. The paper making machine of claim 38, wherein said transfer belt has a thickness in the range of approximately 4 mm to 5 mm.

45. A method of manufacturing a material web, including a suction take-off roll, a pressing element comprising one of a soft counter roll and a curved pass shoe, the pressure element defining an extended pressing gap between said take-off roll and a transfer surface, the transfer surface comprising one of a flexible press jacket and a transfer belt and having a pressure element engaging side and an opposite side web carrying side adapted to support said material web, the transfer surface having a path which includes passing through said pressing gap, and an air permeable belt having substantially open surface which also passes through said pressing gap, comprising:

mounting said material web on said transfer surface;

moving said material web via said transfer surface to said pressing gap;

deforming said transfer surface using a cylindrical surface of the take-off roll, the deforming occuring from said material web carrying side at said pressing gap to form a substantially concave depression in the transfer surface; and transferring said web from said transfer surface to said air permeable belt.

46. The method of claim 45, wherein said transfer surface is a substantially water impermeable transfer belt.

47. The method of claim 46, wherein said transfer surface is substantially smooth.

48. The method of claim 46, wherein said transfer surface has a predetermined roughness.

49. The method of claim 46, wherein said transfer surface has a substantially closed surface.

50. The method of claim 46, further comprising guiding said air permeable belt over at least a portion of said take-off roll.

51. The method of claim 46, wherein said transfer belt is an endless transfer belt, and said substantially concave depression is an inward deflection of said loop.

52. The method of claim 46, further comprising a pressing roll being at least partially made of elastic material that presses against said take-off roll; and deforming said pressing roll to form said substantially concave depression.

53. The method of claim 46, further comprising pressing said transfer surface onto the take-off roll by at least one pressing shoe having a concave pressing surface.

54. The method of claim 53, wherein said transfer surface is a pressing jacket of a shoe pressing roll, and a pressing shoe of said shoe pressing roll applies pressure against said take-off roll.

55. The method of claim 46, wherein said transfer belt is an endless belt, said material web and said belt are pressed against one another between said take-off roll and a counter element, and said substantially concave depression in said transfer surface is produced by a one-sided deformation of said transfer belt, said transfer belt having a corresponding thickness and flexibility resulting from the pressing of the take-off roll into the transfer belt.

56. The method of claim 46, wherein said air permeable belt is a drying screen of a drying section.

57. A paper making machine for manufacturing a material web, comprising:

a suction take-off roll having a cylindrical surface;

a soft counter roll which applies pressure against the take-off roll to define an extended pressing gap therebetween wherein a substantially concave shaped depression is formed in the soft counter roll by the cylindrical surface of the take-off roll;

an endless impermeable transfer belt having a pressure element engaging side and an opposite web carrying side adapted to carry the web, the transfer belt looping around a plurality of guide rolls, passing through the extended pressing gap, and being deflected into the concave shaped depression of the soft counter roll from the web carrying side by the cylindrical surface of the take-off roll;

an air-permeable belt having a substantially open surface, the belt being guided over the take-off roll to pass through the extended pressing gap, the air-permeable belt being deflected into the concave depression of the soft counter roll by the cylindrical surface of the take-off roll;

wherein the endless transfer belt, the web, and the air-permeable belt are deflected into the soft counter roll via the cylindrical surface of the take-off roll and wherein the web will transfer from the transfer belt to the air-permeable belt in the region of the extended pressing gap.

58. A paper making machine for manufacturing a material web, comprising:

a suction take-off roll having a cylindrical surface;

a pressure element comprising a pressing shoe having a concave shaped depression, the pressure element applying pressure against the take-off roll to define an extended pressing gap therebetween;

an endless impermeable transfer belt having a pressure element engaging side and an opposite web carrying side adapted to carry the web, the transfer belt looping around a plurality of guide rolls, passing through the extended pressing gap, and being deflected into the concave shaped pressing shoe from the web carrying side by the cylindrical surface of the take-off roll;

an air-permeable belt having a substantially open surface, the belt being guided over the take-off roll to pass through the extended pressing gap, the air-permeable belt being deflected into the concave depression by the cylindrical surface of the take-off roll;

wherein the endless transfer belt, the web, and the air-permeable belt are deflected into the concave shaped depression via the cylindrical surface of the take-off roll and wherein the web will transfer from the transfer belt to the air-permeable belt in the region of the extended pressing gap.

59. A paper making machine for manufacturing a material web, comprising:

a suction take-off roll having a cylindrical surface;

a pressure element comprising a pressing shoe having a concave shaped depression, the pressure element applying pressure against the take-off roll to define an extended pressing gap therebetween;

a flexible press jacket having a pressure element engaging side and an opposite web carrying side adapted to carry the web, the flexible press jacket passing through the extended pressing gap and being deflected into the concave shaped pressing shoe from the web carrying side by the cylindrical surface of the take-off roll;

an air-permeable belt having a substantially open surface, the belt being guided over the take-off roll to pass through the extended pressing gap, the air-permeable belt being deflected into the concave depression by the cylindrical surface of the take-off roll;

wherein the flexible press jacket, the web, and the air-permeable belt are deflected into the concave shaped depression via the cylindrical surface of the take-off roll and wherein the web will transfer from the flexible press jacket to the air-permeable belt in the region of the extended pressing gap.

60. A paper making machine for manufacturing a material web, comprising:

a suction take-off roll having a cylindrical surface;

a pressure element comprising a pressing shoe having a convex shaped surface, the pressure element applying pressure against the take-off roll to define an extended pressing gap therebetween;

a flexible press jacket having a pressure element engaging surface and an opposite web carrying surface adapted to carry the web, the flexible press jacket passing through the extended pressing gap;

the flexible press jacket being deformed by the cylindrical surface of the take-off roll to form a substantially concave shaped depression in the web carrying surface of the flexible press jacket;

an air-permeable belt having a substantially open surface, the belt being guided over the take-off roll to pass through the extended pressing gap, the air-permeable belt being deflected into the concave depression by the cylindrical surface of the take-off roll;

wherein the web and the air-permeable belt are deflected into the concave shaped depression via the cylindrical surface of the take-off roll and wherein the web will transfer from the flexible press jacket to the air-permeable belt in the region of the extended pressing gap.

61. A paper making machine for manufacturing a material web, comprising:

a suction take-off roll having a cylindrical surface;

a pressure element comprising a pressing shoe having a convex shaped surface, the pressure element applying pressure against the take-off roll to define an extended pressing gap therebetween;

an endless impermeable transfer belt having a pressure element engaging surface and an opposite web carrying surface adapted to carry the web, the transfer belt looping around a plurality of guide rolls and passing through the extended pressing gap;

the transfer belt being deformed by the cylindrical surface of the take-off roll to form a substantially concave shaped depression in the web carrying surface of the transfer belt;

an air-permeable belt having a substantially open surface, the belt being guided over the take-off roll to pass through the extended pressing gap, the air-permeable belt being deflected into the concave depression by the cylindrical surface of the take-off roll;

wherein the web and the air-permeable belt are deflected into the concave shaped depression via the cylindrical surface of the take-off roll and wherein the web will transfer from the transfer belt to the air-permeable belt in the region of the extended pressing gap.

* * * * *